United States Patent [19]

Bosman

[11] 4,121,410

[45] Oct. 24, 1978

[54] DOUBLE TWISTING MACHINE

[76] Inventor: Aleidus Gerard Bosman, Van Bergenlaan, 17, Wassenaar, Belgium

[21] Appl. No.: 779,541

[22] Filed: Mar. 21, 1977

[30] Foreign Application Priority Data

Mar. 22, 1976 [BE] Belgium ..... 839884

[51] Int. Cl.[2] ..... D01H 7/86; D01H 7/28

[52] U.S. Cl. ..... 57/58.63; 57/58.81; 57/58.83; 57/58.86

[58] Field of Search ..... 57/58.49, 58.63, 58.72, 57/58.81, 58.83, 58.86, 113

[56] References Cited

U.S. PATENT DOCUMENTS

| | | | |
|---|---|---|---|
| 2,240,153 | 4/1941 | Carter et al. | 57/58.86 |
| 3,613,348 | 10/1971 | Costa | 57/58.86 |
| 3,867,809 | 2/1975 | Holbrook | 57/58.63 X |
| 3,956,875 | 5/1976 | Lenorak | 57/58.83 X |

FOREIGN PATENT DOCUMENTS

| | | |
|---|---|---|
| 1,924,003 | 11/1970 | Fed. Rep. of Germany. |
| 623,573 | 12/1935 | Fed. Rep. of Germany. |
| 92,114 | 8/1959 | Netherlands. |

*Primary Examiner*—Charles Gorenstein
*Attorney, Agent, or Firm*—Finnegan, Henderson, Farabow & Garrett

[57] ABSTRACT

There is described a double twisting machine with a guide to receive the element to be twisted which is unwound from a bobbin arranged on the bobbin holder, and to lead said element from opposite the one bobbin-holder end about the bobbin up to opposite the other bobbin-holder end, said guide being revolvable about an axis in parallel relationship with the bobbin-holder rotation axis relative to said frame and said guide being located completely outside the bobbin-holder with a part at each end of said bobbin-holder. That guide part which first receives the element to be twisted from the bobbin, opens on the one end of the bobbin-holder in such a way that said element to be twisted is unwound substantially axially from the bobbin, and the device comprises means for opposing the rotating of the bobbin holder about the rotation axis thereof as the guide revolves and consequently for retaining the bobbin-holder stationary.

10 Claims, 6 Drawing Figures

DOUBLE TWISTING MACHINE

This invention relates to a double twisting machine which comprises (a) a frame, (b) a bobbin holder which is rotatably mounted relative to said frame, (c) a guide to receive the element to be twisted which is unwound from a bobbin arranged on the bobbin holder, and to lead said element from opposite the one bobbin-holder end about the bobbin up to opposite the other bobbin-holder end, said guide being revolvable about an axis in parallel relationship with the bobbin-holder rotation axis relative to said frame and said guide being located completely outside the bobbin-holder with a part at each end of said bobbin-holder, (d) means to impart to both guide parts located at both bobbin-holder ends, a revolution about the guide rotation axis, and (e) a brake mechanism to put the element to be twisted under tension.

In the known double twisting machines of this kind, the bobbin-holder rotates together with the bobbin during the twisting. The element to be twisted is unwound radially from the bobbin and received by the guide next to the bobbin. Said known machines are relatively expensive due to their being provided with a particular braking mechanism to brake the bobbin-holder with the bobbin when the revolving of said guide stops. The same braking mechanism is actually generally used to put the element to be twisted under a constant tension as it is unwound, so that no further braking mechanism is required therefor, but still due to the particular requirements to be fulfilled by the braking mechanism, said known machines are relatively expensive. Moreover, the braking mechanisms are not always safe in service in such a way that the bobbin can go on rotating after the guide has stopped, with all of the damaging results therefrom.

The invention has for object to obviate said drawbacks and to provide a double twisting machine with a high throughput, which is however simple and unexpensive and whereby any danger of fouling of the element to be twisted due to the bobbin rotating after the guide stoppage, is completely excluded.

For this purpose, that guide part which first receives the element to be twisted from the bobbin, opens on the one end of the bobbin-holder in such a way that said element to be twisted is unwound substantially axially from the bobbin, and the device comprises means for opposing the rotating of the bobbin holder about the rotation axis thereof as the guide revolves and consequently for retaining the bobbin-holder stationary.

Double twisting machines with stationary bobbin-holder are known, but such machines are not of the same type with which the invention is concerned. In said machines with stationary bobbin-holder, said bobbin-holder is rotatably mounted on a base which is driven. The element to be twisted is also unwound substantially axially from the bobbin in this case but it is then led along that end remote from the base, through the core of the bobbin holder proper to the rotating basis. The element to be twisted is curved in this case and directed radially outwards to then run along the base towards a fixed part of the guide on the other side of the bobbin-holder. In said machines, the bobbin-holder does not only form itself a part of the guide but also those guide parts at both ends of the bobbin holder are not both revolved. The base only is driven. The bobbin-holder is arranged inside a housing whereby the bobbin size is limited. Moreover in said known machines, it is impossible to use very rough elements to be twisted as the curvature radius of some bends of the element to be twisted is too small therefor with said machines.

In a particular embodiment of the invention, the double twisting machine comprises at least one resilient cord-like element which runs about the bobbin-holder from the one end thereof to the other and which is made fast to components which are stationary relative to the bobbin-holder during the guide revolution.

Said resilient elements prevent lays falling from the bobbin.

In an advantageous embodiment of the invention, the braking mechanism comprises at least two wheels which are mounted opposite one another on either side of the guide rotation axis, on that guide portion which the element to be twisted reaches first as it is unwound from the bobbin, and means for braking down the rotation of said wheels.

The braking mechanism wheels are undriven to the contrary of the known double twisting machines, which makes the construction simpler.

In a preferred embodiment of the invention, the double twisting machine further comprises a pre-braking mechanism for the element to be twisted, which is located between the braking mechanism proper and the nearest end of the bobbin-holder, and means to retain the pre-braking mechanism as well as the bobbin-holder stationary relative to the frame while the guide revolves.

In this embodiment, the running back of the windings up to the bobbin is prevented.

The invention has also for object to make the construction of such a double twisting machine, whether according to one of the previous embodiments or not, simpler and more unexpensive.

For this purpose, the revolving guide of the double twisting machine comprises at least two completely discrete rotating parts, one opposite each bobbin-holder end and the means for causing the guide to revolve drive but one of said parts, while the driving of the other part occurs through the action of the already once-twisted element to be twisted which runs between both parts and insures in itself the connection of said parts.

The element to be twisted should however be strong enough because while taking into account the tension to which it is subjected after being already twisted once, it should have enough rigidity and strength between both guide parts.

Other details and features of the invention will stand out from the following description given by way of non-limitative example and with reference to the accompanying drawings, in which.

In the various figures, the same reference numerals pertain to similar elements.

Figure 1:
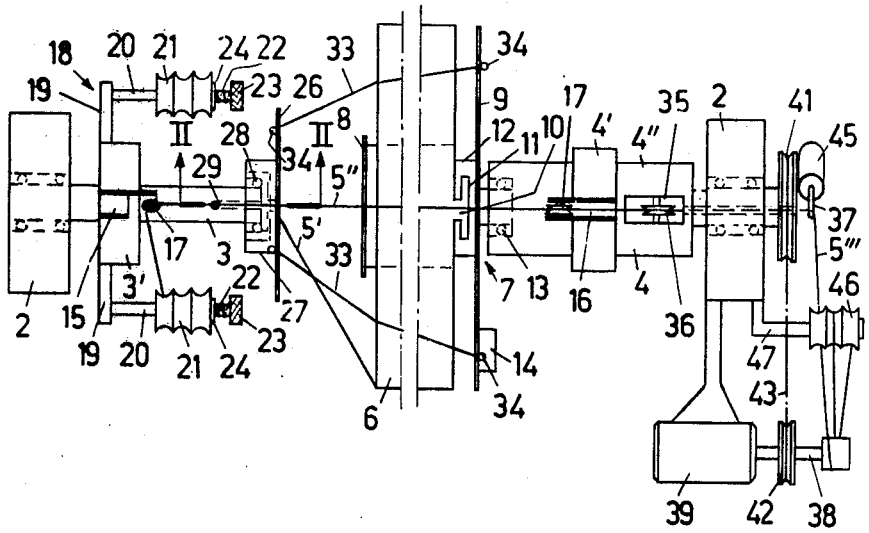
FIG. 1 is a top plan view of a double twisting machine according to the invention.
Figure 4:
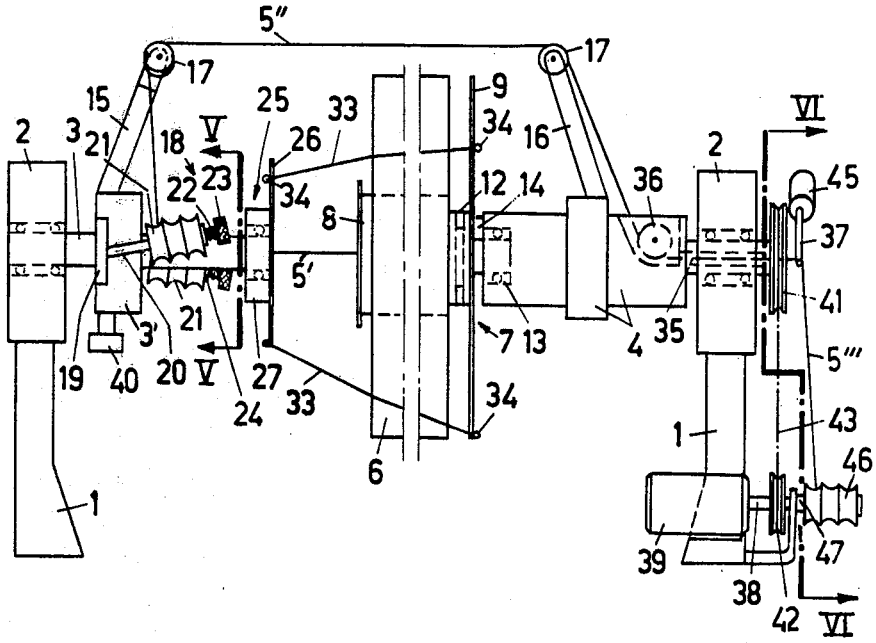
FIG. 4 is a side view of the double twisting machine according to the preceding figures.
Figure 2:
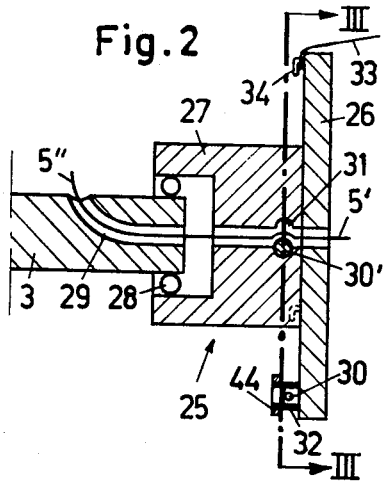
FIG. 2 is a cross-section along line II—II in FIG. 1, but drawn on a larger scale.
Figure 3:
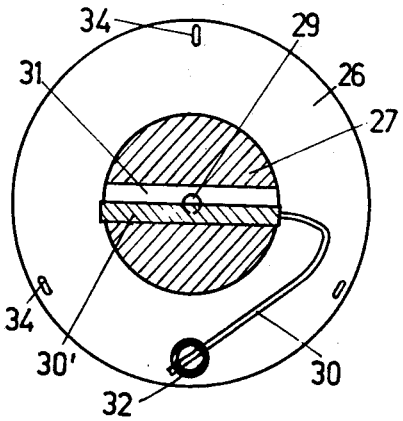
FIG. 3 is a cross-section along line III—III in FIG. 2.
Figure 5:
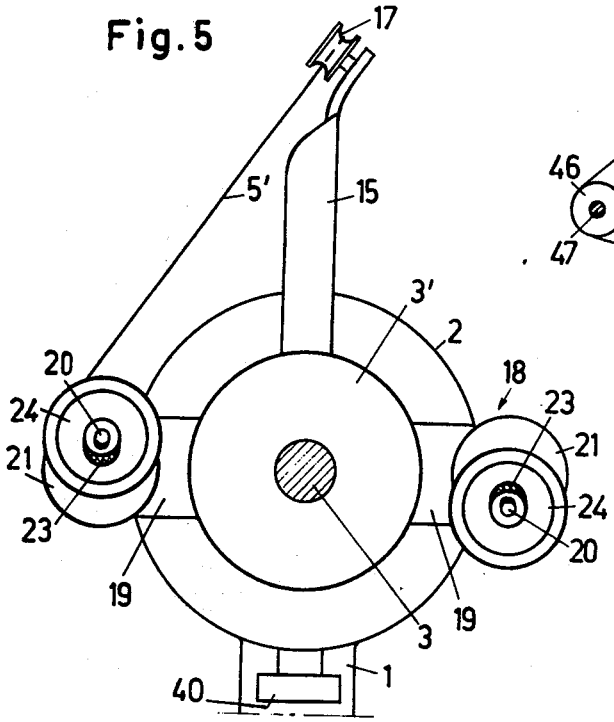
FIG. 5 is a cross-section along line V—V in FIG. 4 but drawn on a larger scale.

The double twisting machine as shown in the figures comprises a frame from which but two legs 1 have been shown in the drawing. Said two legs 1 which bear on the ground, support at the top end thereof a ball bearing 2. In the two ball bearings 2 are supported respectively shaft portions 3 and 4 which lie in the extension of one another and which are part of a guide for the element 5 to be twisted.

The element 5 to be twisted is wound in the form of a plastic material ribbon on a bobbin 6. Said element 5 is also present in the machine in a once-twisted form and even in a twice-twisted form, whereby the element thus forms yarns. When mention will be made in the following description of said element as regards more particularly the form thereof, use will be made as the case may be, of the word "ribbon" with the reference numeral 5', of the term "once-twisted yarn" with the reference numeral 5'' and of the term "twice-twisted yarn" with the reference numeral 5'''.

The bobbin 6 with ribbon 5' lies on a bobbin holder 7. Said bobbin holder 7 is comprised of a cylinder-like core 8 with enlarged end and of a round disk 9 projecting outside the core. Said core 8 is provided at the one end thereof with a dovetail-shaped projection 10 which fits inside a corresponding groove 11 in an enlargement 12 in the disk center. The core 8 over which the bobbin 6 is slipped, is thus removable relative to disk 9.

Said disk 9 is connected by means of a ball bearing 13 to that end facing shaft portion 3, of shaft portion 4. The lengthwise axis and thus the rotation axis of the bobbin holder 7 lies thereby in the extension of the rotation axes of the shaft portions 3 and 4. The disk 9 and thus the complete bobbin holder 7 thus can remain stationary when shaft portion 4 rotates. To retain the bobbin holder 7 stationary however, a weight 14 is made fast to the one side of disk 9, with an out-of-center arrangement. By means of said weight 14, the bobbin holder 7 which is arranged between the shaft portions 3 and 4 and which is connected only by means of the ball bearing 13 to the shaft portion 4, will always lie due to gravity in such a position that said weight 14 is as low as possible. When the shaft portion 4 starts to move, the friction in the roller bearing 12 will be too low for the bobbin holder 7 with the out-of-center weight 14 to move therewith.

The guide for the element 5 to be twisted parts of which are the shaft portions 3, 4, further comprises two arms 15 and 16 which are positively mounted on an arrangement of shaft portions 3 and 4 respectively. Said enlargements of shaft portions 3 and 4 bear in the drawings the same reference numerals as the complete components, with a prime sign added. Both arms 15 and 16 slant towards one another away from the shaft portions 3 and 4. On the free ends of two strips of each arm 15 and 16 is rotatingly mounted a small wheel 17. Opposite each arm 15 and 16, a counter-weight 40 a mounted on enlargement 3' and 4'.

On shaft portion 3 is mounted a brake mechanism 18. Said brake mechanism comprises two projections 19 which are made fast opposite one another on the enlargement 3' of shaft portion 3 and which extend in extension of one another. On the same side, on each end of said projections 19 is mounted a shaft 20. Said shafts 20 form small angles opposite one another with the geometrical axis of shaft portion 3. On each shaft 20 is rotatingly but unslidably mounted a brake wheel 21 which is provided with three grooves. The brake wheel on each shaft 20 is undriven, but a possible rotation about its own axis is braked. This occurs by means of a spring 22 which surrounds shaft 20 between brake wheel 21 on the one side, and a knob 23 which is screwed on the threaded end of shaft 20 on the other side. Said spring pushes through a brake disk 24 against the brake wheel. By rotating knob 23, it is possible to adjust the tension of spring 22 and thus also the pressure of brake disk 24 against brake wheel 21, whereby thus the braking is also adjusted. The element 5 to be twisted is led alternately from the brake wheel 21 on the one shaft 20 to the brake wheel 21 on the other shaft 20 and it is finally led from the one brake wheel 21 to the small wheel 17 on the arm 15. Said small wheel 17 is mounted at an angle on arm 16 in such a way that the wheel groove is directed towards said last-mentioned brake wheel 21.

Between said brake mechanism 18 and bobbin-holder 7, a pre-braking mechanism 25 is also mounted on the free end of shaft portion 3. Said pre-braking mechanism 25 comprises a disk 26 which bears in the center of that side thereof facing shaft portion 3, a round journal 27. Said journal 27 is connected by means of a ball bearing 28 to the free end of shaft portion 3. The disk 26 is then directed at right angle to the rotation axis of shaft portion 3. Cross-wise through the center of disk 26 and journal 27 and through the center of the end connecting thereto of shaft portion 3 runs a channel for the ribbon 5' to be twisted. At a distance from the end of shaft portion 3, said channel 29 bends and open on the surface of said shaft portion 3, between the ball bearing 27 and the enlargement 3'. The disk 26 and the journal 27 are not however part of the guide for the element 5 to be twisted. Said ribbon 5' which is unwound from the circumference of bobbin 6, is essentially pulled axially over the head end of said bobbin and led to the side of disk 26 inside channel 29. Said ribbon 5' undergoes a first twisting in the channel 29 proper and thus comes out as once-twisted yarn 5'' at a distance from the free end of shaft portion, from channel 29. As already stated above, said once-twisted yarn 5'' is led alternately over the brake wheels 21 of the brake mechanism 19. The unwound ribbon 5' is already pre-braked by the pre-braking mechanism 25 in that portion of channel 29 which runs through journal 27. The pre-braking mechanism comprises therefor a hairpin spring 30 the one leg of which bears a cylinder-like enlargement 30'. With said enlargement the leg enters an opening 31 with oblong cross-section which runs through journal 27 and crosses channel 29. The cross-section lengthwise direction of opening 31 runs in parallel relationship with the plane of disk 26. The other leg of hairpin spring 30 goes through a small hollow shaft 32 which is mounted on the side facing shaft portion 3 of disk 26 and it is clamped inside said shaft by means of a nut 44 screwed on the small shaft. The hairpin spring 30 lies under tension in such a way that both legs thereof try to spread away. The ribbon 5' runs in channel 29 on the side of enlargement 30' of the one spring leg which is fartest away from the other leg. The first-mentioned leg which thus tries to move away from said last-mentioned leg, then pushes ribbon 5' away from its path in opening 31. Where end 30' lies, the ribbon 5' follows an arc around said end 30' whereby friction and thus braking action are caused. Due to the disk 26 and journal 27 being connected to shaft portion 3 through a ball bearing, said disk 26 with journl 27 can be retained stationary when shaft portion 3 rotates. Said disk 26 is retained stationary by means of three resilient ribbons 33. At both ends of said ribbons are provided loops. When the one loop-shaped end, each ribbon 33 hooks over a small hook 34 which is made fast to the disk 9 and with the other loop-shaped end, each ribbon 33 hooks over a small hook 34 which is made fast to disk 26. As disk 9 is retained stationary, the disk 26 will also be retained stationary by means of the resilient ribbons 33. The three ribbons 33 lie resiliently around bobbin 6, said ribbons being distributed over the bobbin circumference. Said ribbons can easily be removed or replaced when required. By means of said resilient ribbons 33, the fall of lays from bobbin 6 is substantially excluded while the unwinding of ribbon 5' from bobbin 6 is in no way limited. Due to the pre-braking with pre-braking mechanism 25, one prevents the windings of yarn 5" formed inside channel 29 moving towards bobbin 6.

Figure 6:
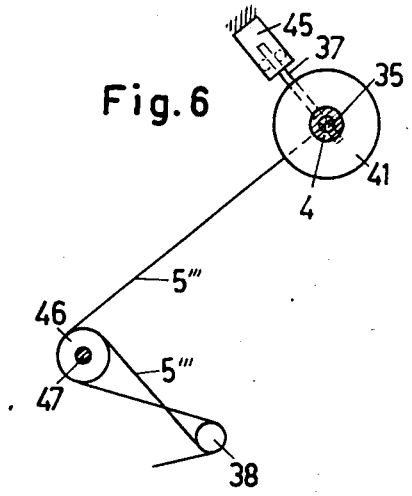
FIG. 6 is a cross-section along line VI—VI in FIG. 4 but drawn also on a larger scale.

It is already been stated above how ribbon 5' is unwound from bobbin 6 and led to brake mechanism 25. The already once-twisted yarn 5" runs therefrom round the small wheel 17 which is mounted on arm 15 and from there about bobbin 6 towards the small wheel 17 mounted on arm 16. Inside shaft portion 4 is provided a channel 35 which runs for the major part along the rotation axis of shaft portion 4 and opens with one end on that end of shaft portion remote from shaft portion 4. The other end of channel 35 is bent and opens on the circumference of a second thicker portion 4" of said shaft portion 4. Said last end has however a larger cross-section and inside said end a small wheel 36 is rotatingly mounted on shaft portion 4. The once-twisted yarn 5" that is led around the small wheel 17 on arm 16 is then led round the small wheel 36 and thus brought into channel 35 and comes out as twice-twisted yarn 5''' on the free end of shaft portion 4. The twice-twisted yarn is then as shown more particularly in FIG. 6, led round downwards about a finger 37 which is supported in a bearing 45 which is mounted on a part not shown in the figures, of the frame. Immediately above the floor, the ribbon 5 is led alternately between a grooved diverting wheel 46 and the grooved shaft 38 of a motor 39. The diverting wheel 46 is rotatingly mounted on a shaft 47 which is mounted on a part connected to leg 1, of the frame. Motor 39 is made fast to leg 1 and thus drives the yarn 5''', in such a way that the ribbon 5' is still further unwound from bobbin 6.

The complete guide for the element 5 to be twisted is actually comprised of two separate parts, namely a first part formed by the shaft portion 3 with part of channel 29, the arm 15 mounted thereon and the brake mechanism 18 mounted thereon and a second part formed by the shaft portion 4 with channel 35 and the arm 16 mounted thereon. The single connection between both these guide parts is formed by the once-twisted yarn 5" itself which runs between arms 15 and 16. Said yarn 5" has enough strength and lies under enough tension to cause when the one part is driven, the other guide part to rotate together at the same speed. In the embodiment shown in the figures, but shaft portion 4 is driven and actually by the same motor 39 which also drives element 5. On that end of shaft portion 4 remote from disk 9, a pulley 41 is made fast for this purpose, while also a pulley 42 is made fast on the shaft 38 of motor 39. A belt 43 runs over both pulleys 41 and 42.

The number of twists per unit length of twisted yarn 5''' obtained for a given r.p.m. of motor 39, is a function of the transmission ratio of the pulley transmission between shaft 38 of motor 39 and shaft portion 4 and is also a function of the speed with which element 5 is driven, that is thus of the diameter of that shaft 38 which drives said element 5.

The above-described device is cheap because the bobbin-holder 7 does not rotate together and thus no complex braking device is required for the bobbin, and because the connection between both independent parts of the guide occurs through the element to be twisted itself, in such a way that but one shaft portion should be driven and consequently on the one hand, a transmission between both shaft portions can be dispensed with and on the other hand, an accurate alinement is not required for the shaft portions 3 and 4. The brake wheels 21 are not driven either.

Moreover a faulty working of the machine is avoided in a very cheap and simple way. On the one hand due to the resilient ribbons 33, the fall of lays from the bobbin 6 is avoided, while due to the pre-braking mechanism 25 which is retained stationary by the same resilient ribbons, the displacement of windings towards the bobbin 6 becomes impossible.

It must be understood that the invention is in no way limited to the above embodiments and that many changes may be brought therein without departing from the scope of the invention as defined by the appended claims.

What I claim is:

1. A double twisting machine comprising:
   a. a frame,
   b. a guide with at least two parts laying opposite to one another, which guide is rotatably mounted on the frame,
   c. means for rotating said guide,
   d. a bobbin holder, mounted on one of the guide parts for rotation about an axis extending from said guide part in the direction of the opposite guide part, said guide being located outside the bobbin holder, said guide guiding the element to be twisted which is unwound from a bobbin on the holder about the bobbin from the part which is free on the bobbin to the opposite part on which the holder is mounted,
   e. means for opposing rotation of the bobbin holder with respect to the frame as the guide rotates and consequently for retaining the bobbin holder stationary and,
   f. at least one resilient cord-like element which runs along the stationary bobbin holder from one end thereof to the other end, which is made fast to the components which are stationary relative to the bobbin holder during the guide revolution, in order to prevent lays from falling off a bobbin on the holder.

2. A double twisting machine as defined in claim 1, which comprises three resilient cord-like elements which are distributed over the circumference of the bobbin holder, running from one end of the bobbin holder to the other.

3. A double twisting machine as defined in claim 1, in which the resilient element is connected at one end to the bobbin holder.

4. In a double twisting machine comprising:
   a. a frame,
   b. a bobbin holder rotatably mounted relative to said frame, c. a guide receiving the element to be twisted which is unwound from the bobbin arranged on the bobbin holder, and to lead said element from opposite one bobbin-holder end about the bobbin up to and opposite the other bobbin-holder end, said guide being revolvable about an axis in parallel relationship with the bobbin-holder rotational axis relative to said frame and said guide being located completely outside the bobbin holder with a part at each end of said bobbin-holder, d. means to impart rotation to both guide parts located at both bobbin-holder ends, about the guide rotation axis, and e. a brake mechanism to put the element to be twisted under tension, said brake mechanism comprising at least two wheels which are mounted opposite one another on either side of the guide rotation axis, on that guided portion which the element to be twisted reaches first as it is unwound from the bobbin and means for braking down the rotation of said wheels, the improvement that that guide part which first received the element to be twisted from the bobbin opens onto one end of the bobbin-holder in such a way that the element to be twisted is unwound substantially axially from the bobbin, and the device comprises means for opposing the rotation of the bobbin holder about the rotational axis thereof as the guide revolves and consequently for retaining the bobbin holder stationary.

5. Double twisting mechanism as defined in claim 4, in which the brake wheels lie rotatingly but unslidably on shafts and the means for braking the revolving of each such wheel comprise a spring element which is arranged between a projection on one end of each shaft and the wheel bearing on the projection and pressing on the wheel through a small brake disk.

6. A double twisting machine comprising:

a. a frame, b. a guide with at least two parts laying opposite one another, which guide is rotatably mounted on the frame, c. means for rotating said guide, d. a bobbin holder, mounted on one of the guide parts for rotation about an axis extending from said one guide part in the direction of the opposite guide part, said guide being located outside the bobbin holder, said guide guiding the element to be twisted which is unwound from a bobbin on the holder about the bobbin from the part which is free on the bobbin to the opposite part on which the holder is mounted, e. means for opposing rotation of the bobbin holder with respect to the frame as the guide rotates and consequently for retaining the bobbin holder stationary and, f. a brake mechanism mounted on the guide to put under tension the element to be twisted and rotating with the guide, g. a pre-braking mechanism for the element to be twisted, which is located between the braking mechanism and the nearest end of the bobbin holder, said pre-braking mechanism being rotatably supported relative to the guide and comprising a disk provided with an opening for the element to be twisted, and a hairpin spring associated with said disk and pushing resiliently with one leg against the element to be twisted, h. and means to retain said disk stationary relative to the frame while the guide revolves.

7. A double twisting machine as defined in claim 6, which comprises at least one resilient cord-like element which runs along the stationary bobbin holder from one end thereof to the other end and which is made fast to the components which are stationary relative to the bobbin holder during the guide revolution, the means which retain the disk of the pre-braking mechanism stationary being formed by this resilient cord-like element which is connected with one end to the disk.

8. A double twisting machine comprising:

a. a frame, b. a guide with at least two completely discrete rotating parts, which are rotatably mounted on the frame, c. means for driving but one of said parts, the driving of the other part occurring through the action of the already once-twisted element to be twisted which runs between both parts and insures in itself the connection of said parts, d. a bobbin holder, mounted on one of the guide parts, for rotation about an axis extending from said one guide part in the direction of the opposite guide part, said guide being located outside the bobbin holder, said guide guiding the element to be twisted which is unwound from a bobbin on the holder about the bobbin from the part which is free on the bobbin to the opposite part on which the holder is mounted, e. means for opposing rotation of the bobbin holder with respect to the frame as the guide rotates and consequently for retaining the bobbin holder stationary and, f. a brake mechanism mounted on the guide to put under tension the element to be twisted which is substantially axially unwound from the bobbin on the holder.

9. A double twisting machine comprising:

a. a frame b. a guide with at least two parts laying opposite to one another, which guide is rotatably mounted on the frame, c. means for rotating said guide, d. a bobbin holder, mounted on one of the guide parts, for rotation about an axis extending from said one guide part in the direction of the opposite guide part, said guide being located outside the bobbin holder, said guide guiding the element to be twisted which is unwound from a bobbin on the holder about the bobbin from the part which is free on the bobbin to the opposite part on which the holder is mounted, e. means for opposing the rotation of the bobbin holder with respect to the frame as the guide rotates and consequently for retaining the bobbin holder stationary and, f. a brake mechanism mounted on the guide to put the element to be twisted under tension which is substantially axially unwound from a bobbin on the holder, the brake mechanism comprising at least two wheels which are mounted opposite one another on either side of the guide rotation axis, on that guide part which the element to be twisted reaches first as it is unwound from the bobbin, and means for braking the rotation of said wheels.

10. Double twisting mechanism as defined in claim 9, in which the brake wheels lie rotatingly but slidably on shafts and the means for braking the revolving of each such wheel comprise a spring element which is arranged between a projection on one end of each shaft and the wheel, bearing on the projection and pressing on the wheel by means of a small brake disc.

* * * * *